US005474197A

United States Patent [19]

Hillis et al.

[11] Patent Number: 5,474,197

[45] Date of Patent: Dec. 12, 1995

[54] COLLAPSIBLE CONTAINER WITH REDUCED DEFLECTION

[75] Inventors: Mark Hillis, Tacoma; Clifford R. Perry, Federal Way; Cheryl M. Reiland, Tacoma, all of Wash.

[73] Assignee: Perstorp Xytec, Tacoma, Wash.

[21] Appl. No.: 173,610

[22] Filed: Dec. 27, 1993

[51] Int. Cl.[6] ..... B65D 88/00

[52] U.S. Cl. ..... 220/6; 220/1.5; 220/4.28

[58] Field of Search ..... 220/1.5, 4.28, 220/6

[56] References Cited

U.S. PATENT DOCUMENTS

| | | | |
|---|---|---|---|
| 4,085,847 | 4/1978 | Jacalone . | |
| 4,192,430 | 3/1980 | Cornou | 220/1.5 |
| 4,305,508 | 12/1981 | Rodgers . | |
| 4,331,234 | 5/1982 | Gilbert . | |
| 4,391,371 | 7/1983 | Sieffert . | |
| 4,646,928 | 3/1987 | Ono et al. . | |
| 4,674,647 | 6/1987 | Gyenge et al. | 220/1.5 X |
| 4,693,386 | 9/1987 | Hughes et al. | 220/6 X |
| 4,720,020 | 1/1988 | Su . | |
| 4,735,331 | 4/1988 | Keenan et al. . | |
| 4,844,277 | 7/1989 | Su . | |
| 4,880,141 | 11/1989 | Gossler et al. . | |
| 4,917,255 | 4/1990 | Foy et al. | 220/4.28 X |
| 4,940,155 | 7/1990 | Hewson . | |
| 4,967,927 | 11/1990 | Reiland . | |
| 5,000,372 | 3/1991 | Hollander . | |
| 5,038,953 | 8/1991 | Radar | 220/6 |
| 5,110,037 | 5/1992 | Pieritz, Sr. . | |
| 5,114,037 | 5/1992 | Hillis et al. . | |
| 5,147,061 | 9/1992 | Karpisek | 220/1.5 X |
| 5,161,709 | 11/1992 | Oestreich, Jr. | 220/1.5 X |
| 5,199,592 | 4/1993 | Reiland et al. . | |
| 5,289,935 | 3/1994 | Hillis et al. . | |

*Primary Examiner*—Steven M. Pollard

*Attorney, Agent, or Firm*—Townsend and Townsend and Crew

[57] ABSTRACT

A collapsible, foldable container with reduced deflection and increased strength and convenience is provided. A door can be provided in the lower portion in one or more of the sidewalls, opening upward and outward without unduly loading the door hinges. A latch is provided to hold the door in the open configuration engageable by slamming open and disengaging by jerking close. In one embodiment, the base of the container includes a plate having ribbing extending upwardly therefrom. When a smooth-bottomed surface is desired, a plate may be installed on top of the upwardly extending ribbing. Ribbing on the bottom surface and/or sidewall surfaces can include close-loop or circular ribs with integral ribbing extending radially therefrom. Preferably, containers are configured so that they can be stacked, one upon the other, either with or without a top or lid. Preferably, the lid, when provided, avoids pooling of liquids such as rainwater by having a domed-shape and by providing channels in a peripheral ridge. Sagging in the components of the container can be at least partially avoided by providing ribbing in regions extending from the center of the bottom of the container towards peripheral portions, preferably corners.

7 Claims, 7 Drawing Sheets

COLLAPSIBLE CONTAINER WITH REDUCED DEFLECTION

The present invention is directed to a container, such as a box, with folding or collapsible sidewalls and in particular to a container having reduced outward deflection and reduced vertical sag. Cross-reference is made to commonly assigned U.S. patent application Ser. No. 07/845,121, filed Mar. 3, 1992, incorporated herein by reference.

BACKGROUND OF THE INVENTION

A number of containers having hinged or otherwise collapsible sidewalls have been proposed, since collapsing sidewalls provides the ability to reduce the volume required for such containers during storage or initial shipment and, for reusable containers, during return-shipment. Containers of this type, however, have often been subject to certain problems or deficiencies. In some configurations, there has been a tendency of the containers to experience a vertical downward deflection near the center of the sidewalls (or base) or "sag" over time. This has been especially pronounced in certain configurations designed for stacking containers vertically one on top of the other. Such sag makes it difficult to efficiently pack containers into a limited space and contributes to material fatigue, eventually leading to failure of the container. Some previous devices have attempted to diminish the sag effect by adding reinforcing beams across the lower surface of the container. However, such beams have often interfered with providing the capability of four-way forklift entry since such beams typically run transverse to the path of forks of a forklift along at least one direction of entry.

Another troublesome type of deflection has been outward sidewall deflection. Use of the containers to transport dense loads results in outward forces being applied to the sidewalls and some amount of deflection often results. This deflection interferes with efficient packing of containers into a confined space. In some applications, containers are designed so that an integral number can be efficiently, (i.e., tightly, with no wasted space) packed into a larger vessel such as the hold of a cargo ship, a trailer, an airplane, etc. However, if the sidewalls of such containers have experienced deflection and, for example, undergone "ballooning," such containers will no longer pack correctly into such defined spaces. Furthermore, if containers are subject to sidewall deflection, even if containers have been successfully packed into a larger vessel, if sidewall deflection occurs after such packing, the containers may become tightly jammed into the larger vessel and it may be difficult to extract such jammed vessels.

In some instances, containers are provided with a removable top or lid, e.g., to protect the contents of the container during shipment, storage, etc. Previous lid devices have often been incompatible with container stacking such that containers were designed to stack in an unlidded condition, or to stack in a lidded condition, but not both. Previous lids with a stacking capability were sometimes susceptible to formation of pools if subjected to water, such as rainwater. Many previous lids added a significant amount of height to the container, particularly if the lids were configured to accommodate stacking. A number of lid designs were useful for storage but were subject to accidental loss during shipment, e.g., by the force of wind acting on the lids.

In some cases, it is desirable to provide one or more doors within one of the collapsible sidewalls to facilitate removal of the container contents. Previously, it has been difficult to successfully locate a door in the lower portion of a sidewall which is designed to swing outward and upward. The design was particularly difficult when the container was intended for bulk transport (i.e., transport of a large number of discrete and loose or unrestrained items, e.g., loose bolts, washers, etc.). In this application, a large amount of force is applied to the door and it has been difficult to design such a door that will successfully withstand the force without failure or undue deflection.

Previous devices have also been subject to deflection of the bottom surface or floor of the container. Some previous designs have provided for ribbing extending downward from the flat floor surface of the container. However, previous devices have required an excessive amount of ribbing to achieve acceptable strength and stiffness contributing to additional weight and cost of the container.

SUMMARY OF THE INVENTION

According to the present invention, a number of features can be used to reduce or eliminate vertical sag in a container. One feature is a particular reinforcement or ribbing pattern on the base portion of the container. The ribbing pattern used on this embodiment includes a plurality of ribbed regions extending from the central portion of the base of the container radially outward and, preferably, includes four regions in an X-shape extending from the central area of the base to the corners of the base. In one embodiment, there is substantially no ribbing in the interstices between the arms of the X-shaped structure.

Another feature which assists in reducing deflection involves a hinging arrangement which allows the sidewall to be pivoted downward to a collapsed configuration. According to this embodiment of the invention, when the sidewall is in an upright configuration, there is an engagement between a lip extending downward from the sidewall and a lip extending upward from the rim of the base. The base lip is positioned outside the sidewall lip so that outward force on the sidewall is transmitted to the base rim. Preferably, the sidewall lip and the rim lip are substantially continuous along the entire span of the lower edge of the sidewall. The hinging arrangement between the sidewall and the rim is configured so that there are no substantial interruptions of the sidewall lip and the rim lip, even at the location of the hinges. This is believed to avoid an undesirable concentration of forces at stress points.

A further feature useful in reducing deflection involves a rib pattern on the surface, preferably the outside surface of the sidewalls. In this embodiment, the ribbing pattern includes one or more curved, closed-shape ribs, preferably, circular ribs, with a plurality of linear ribs connecting to and radiating therefrom. This configuration is believed to provide a higher stiffness and reduced deflection of the sidewalls.

The present invention also includes a container having a door in one or more of the sidewalls. In this embodiment, the door is in the lower portion of the sidewall and extends from the lower edge of the sidewall upward, but without extending to the upper edge of the sidewall. Preferably, the door is hinged so as to open upwardly and outwardly and has one or more latches coupling the door in the closed configuration, to the base of the container, preferably to a shear plate structure in the base of the container. In one embodiment, outward forces are transmitted by the door to the base of the container.

In one embodiment, the door is held in the open position by a slam latch which is configured to engage the door when the door is slammed into the latch. Preferably, the door can be disengaged by suddenly pulling or jerking the door outward and downward away from the slam latch. In one embodiment, these features are achieved by the angular configurations of a jamming surface and a retaining surface of a slam latch and the resilient nature of the slam latch.

A further aspect of preventing unwanted deflection includes the positioning of ribs in the base of the container. According to one embodiment, the base of the container has an integral planar surface and ribbing attached or, preferably, integral with the planar surface. The ribbing, in this embodiment, extends upward from the planar surface, i.e., in a direction towards the interior of the container. When it is desired that the container should have a flat interior bottom surface, a plate can be positioned on top of the ribbing. Preferably, the base of the container is provided with nine points or regions of support, including support regions at the four corners, support regions at the centers of the four sides and a central support region. This configuration provides for desired support without interfering with accommodating the forks of the forklift.

Preferably, the containers can be stacked one upon the other, either in collapsed positioned, uncollapsed position, with or without a cap or top. When a cap or top is used, preferably the cap or top has a convex or dome shape on the upper surface to avoid pooling of water. In one embodiment, a rim is formed in the upper surface of the cap or lid and, preferably, the rim is provided with one or more channels to avoid pooling of water. The tops or lids can be configured to add on a small amount of height to the overall stack, such as about ¼ inch per container. Preferably, the lids include detentes to grab the rim of the containers so as to avoid blowing off or other unwanted removal.

DETAILED DESCRIPTION OF THE DRAWINGS

DETAILED DESCRIPTIONS OF THE PREFERRED EMBODIMENT

Figure 1:
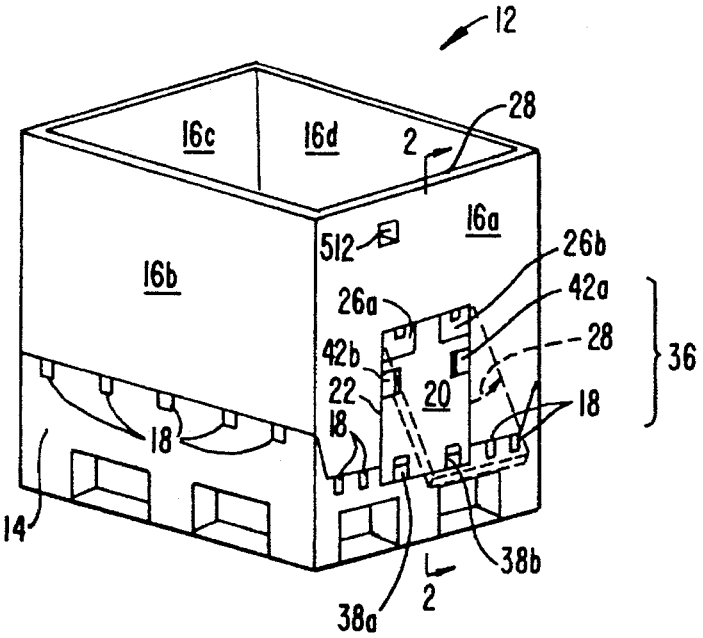
FIG. 1 is a perspective view of a simplified form of one embodiment according to the present invention.

As seen in FIG. 1, a container 12, according to one embodiment of the present invention, includes a base 14 to which are attached four sidewalls 16*a*, 16*b*, 16*c*, 16*d*. A number of materials can be used to form the various components of containers, discussed herein. Preferably, a resin-based and/or structural foam material is used, with parts being formed by injection molding. Preferably, the sidewalls 16*a*, 16*b*, 16*c*, 16*d* are coupled to the base 14 by a plurality of hinges 18. A number of hinge configurations can be used, including those depicted in commonly-assigned U.S. Pat. Nos. 5,114,037 issued May 19, 1992 and 5,199,592 issued Apr. 16, 1993, both of which are incorporated herein by reference.

In the embodiment of FIG. 1, a first sidewall 16*a*, includes a door 20. The door is positioned within an opening 22 formed within the first sidewall 16*a*. The opening extends to the bottom edge of the sidewall 16*a* but does not extend to the top edge 24. The door 20 is coupled to the sidewall 16*a* by hinges 26*a*,, 26*b*, configured so that the door 20 pivots from the closed position lying within the opening 22 about an axis near the top edge of the door outward and upward 28 to an open position 32 preferably fully uncovering the opening 22 and with the door 20 substantially parallel to the sidewall 16*a*. This configuration is particularly useful when the container 12 is used for containing bulk items to facilitate release or removal of the bulk items from the container. One difficulty with providing a door 20 in the lower portion 36 of the sidewall 16*a*, particularly when used for containing bulk material, is the stress placed on the interface between the sidewall 16*a* and the door 20 and particularly the stress placed on the hinges 26*a*, 26*b*. Accordingly, embodiments of the present invention include features to reduce the stress placed on the hinges 26*a*, 26*b*. Another problem with placing a door in the lower portion of the sidewall is that the opening 22 interrupts the couplings such as the hinges 18 by which outward stress on the sidewall 16*a* is transmitted to the base 14. In the depicted embodiment, latches 38*a*, 38*b* are provided on the bottom edge of the door 20. Preferably, the latch and the latched position, extends downward and couples into the base 14, preferably into the shear plate of the base, described more thoroughly below, to transmit outward load to the base 14, despite the absence of hinges 18 within the opening 22. In the depicted embodiment, side latches 42*a*, 42*b* can be used to further distribute the load off of the top hinges 26*a*, 26*b*. A number of latch configurations can be used, including that shown and described in U.S. Pat. No. 5,141,037, supra.

The lower portion door 20 can be provided in any or all of the sidewalls 16*a*, 16*b*, 16*c*, 16*d*. In one embodiment, it is provided in two opposed sidewalls such as 16*a* and 16*c*. Although in FIG. 3 the door 20 is shown as extending somewhat above the top edge 24 of the sidewall 16*a*, in one embodiment, the door, in the open position, will not extend above the upper edge 24 of the sidewall.

Figure 2:
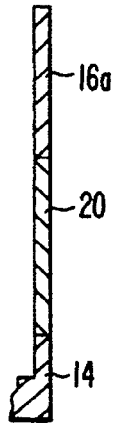
FIG. 2 is a partial cross-sectional view taken along line 2—2 of FIG. 1.
Figure 3:
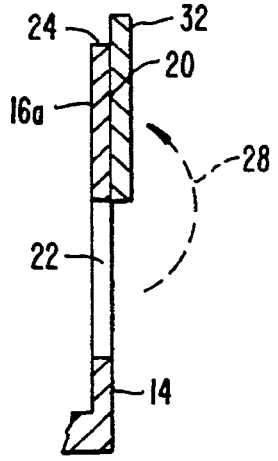
FIG. 3 is a partial cross-sectional view similar to the view of FIG. 2 but showing the door in an open position.
Figure 4:
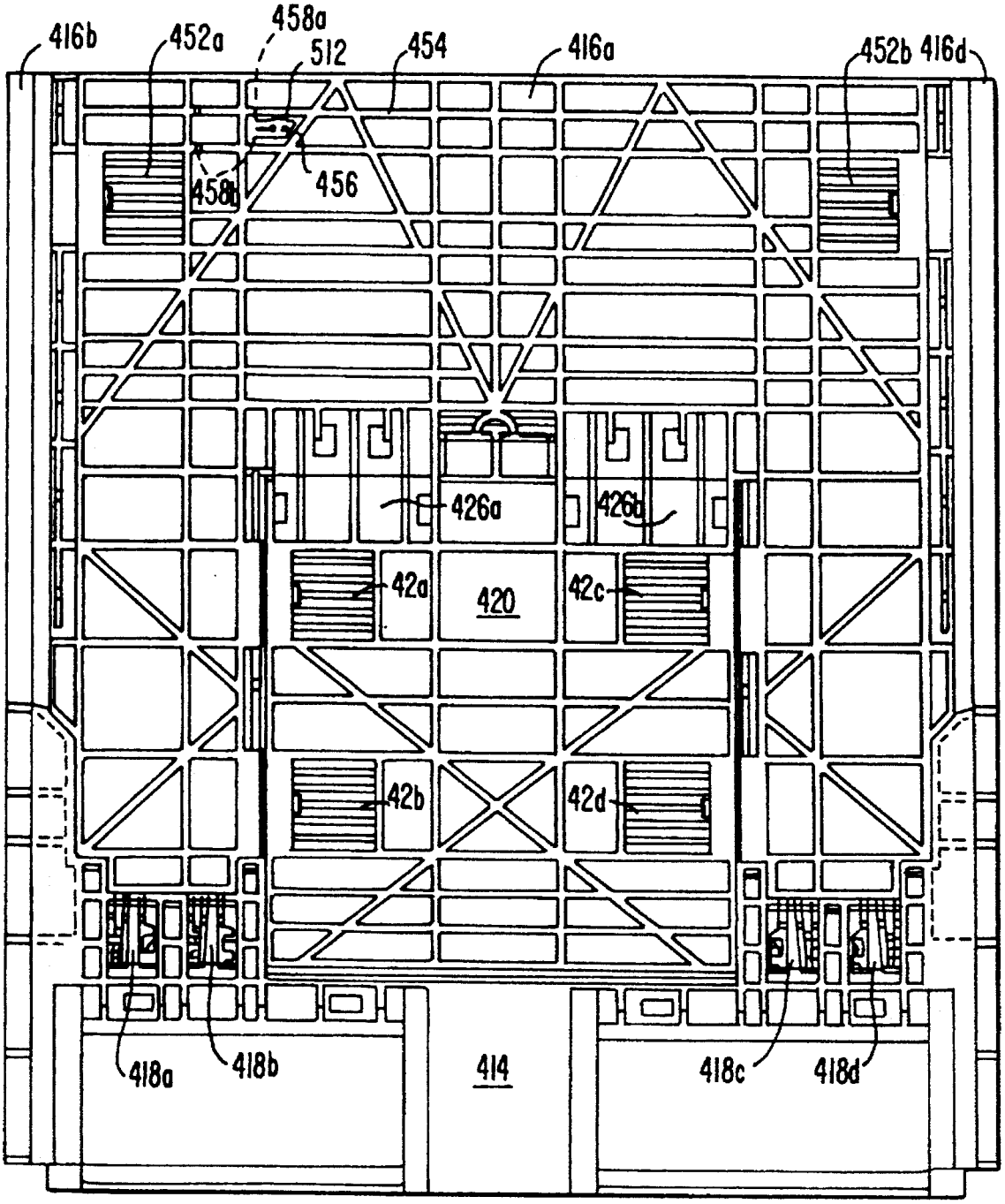
FIG. 4 is a end elevational view of a container having a door in the lower portion of a sidewall according to one embodiment of the invention.

FIGS. 1 through 3 depict a simplified version of the present invention for purposes of ease of description and understanding. FIG. 4 shows an end view of a container with details of a door 420 and a sidewall 416, according to one embodiment of the present invention. The view of FIG. 4 also shows the base 414, second and fourth sidewalls 416*b*, 416*d*. The first sidewall 416*a* is coupled to the base 414 by hinges 418*a*, 418*b*, 418*c*, 418*d*. Door hinges 426*a*, 426*b* couple the upper edge of the door 420 to the sidewall 416*a*. Although, in the embodiment of FIG. 1, latches 38*a*, 38*b* extend downward, in the embodiment of FIG. 4, latches 42*a*, 42*b*, 42*c*, 42*d* extend laterally. Similar latches 452*a*, 452*b* couple the first sidewall 416*a* to the second and third sidewalls 416*b*, 416*d*, as described, for example, in U.S. Pat. No. 5,114,037. Ribbing 454 provides some amount of rigidity to the sidewall 416*a*.

According to one embodiment, the door 20 is held in the open position 32 by a latch 512, such as that depicted in FIGS. 5A–5D. The latch 512 includes an arm portion 514 with hinge pins 516*a*, 516*b* coupled to one end of the arm 514. At the other end of the arm 514 is a latch engagement portion 516 including a camming surface 518 and an engagement surface 520. In one embodiment, the hinging pins 516*a*, 516*b* permit the latch 512 to be located on the door 416 such as in a space 456 between ribs of the sidewall. In one embodiment, holes 458*a*, 458*b* accommodate the hinge pins 516*a*, 516*b*. In this way, the latch 512 can be pivoted from a position with the arm 514 substantially parallel to the sidewall 416*a*, as shown in FIG. 4, for storage to a latching or engaging position with the arm 514 extending outward from the sidewall 416*a* (out of the plane of the paper, in the view of FIG. 4), by rotating the latch 512 about the axis defined by the hinge pins 516*a*, 516*b* approximately 90°. Engagement of the hinge pins 516*a*, 516*b* in the holes 548*a*, 548*b* is accommodated by a slot 520 in the arm 514 allowing the pins 516*a*, 516*b* to be pinched together for fitting into the holes whereupon they will resiliently spring back to lie within the holes 548*a*, 548*b*. The hold-open latch 512 includes wing portions 522*a*, 522*b* which facilitate pivoting around the hinges 516*a*, 516*b*, and also provide some degree of stiffness to the hinge end of the arm 514, facilitate pinching the hinges 516*a*, 516*b* together and provide a degree of resistance to bending of the arm 514. Reinforcing bumps 524*a*, 524*b* also add stiffness to the arm.

Figure 5B:
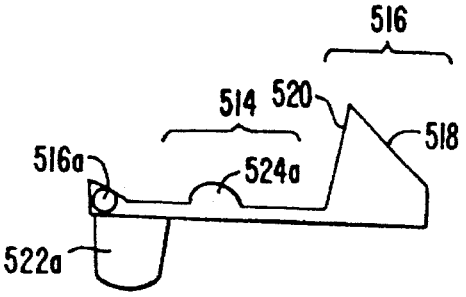
FIGS. 5A–5D are side-elevational, top plan, first end and second end views of a slam latch device according to one embodiment of the invention.
Figure 5A:
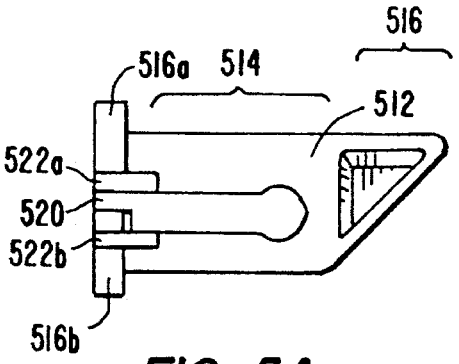
Figure 5C:
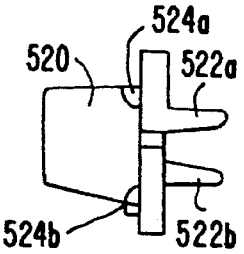
Figure 5D:
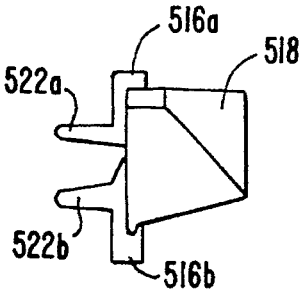
Figure 6:
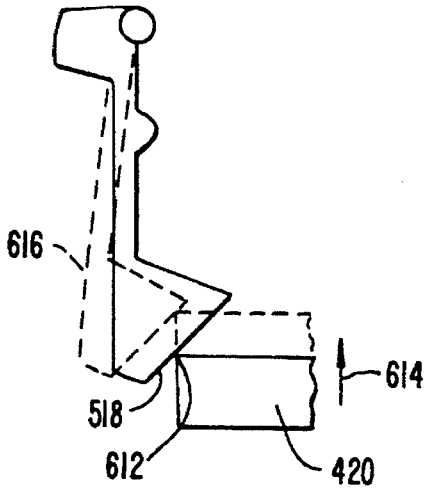
FIG. 6 is a top plan view of a portion of the door as it contacts a slam latch.
Figure 7:
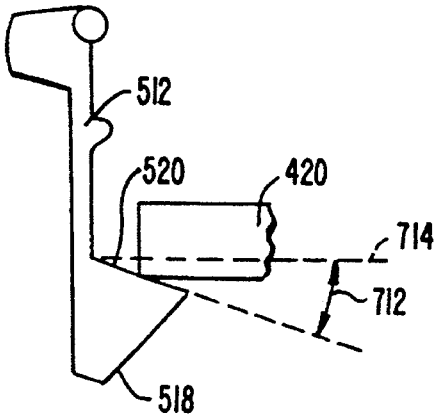
FIG. 7 is a top plan view of a door engaged by a slam latch.

When the latch 512 is in the operative or latching position, it will be positioned as shown in FIG. 5D. As the door 420 is moved upward and outward and the edge of the door approaches the latch 512, the edge of the door will strike the camming surface 518. This is depicted in FIG. 6 which shows the edge or corner 612 of the door 420 striking the camming surface 518. As the door 420 is moved further in a direction 614 towards the sidewall 416*a*, the camming action of the door 420 upon the camming surface 518 causes the arm 514 to flex outward, as shown by the phantom lines, 616 in FIG. 6. With continued movement 614, the door 420 passes beyond the camming surface 518 to be engaged behind the engaging surface 520. Preferably, the engaging surface 520 is configured, so that in the latching position, the engaging surface 520 is at an angle 712 with respect to the plane of the door 714. In one embodiment, the angle 712 is between about 5° and 20°, preferably, about 8°. The angle 712 is sufficiently small that the door 420 is held in the desired position 32 during normal use, i.e., normal unloading of the bulk material from the bin or container. However, the angle 712 is sufficiently large that the door 420 can be released from the latch 512 by grasping the door 420 and sharply pulling outward and downward, causing the arm of the hold-open latch 512 to flex outward 616 thus releasing the door 420.

In order to assist with resisting deflection of the container, one embodiment of the invention provides for ribbing which extends upward from the bottom surface 812 of the base 814 of the container. Many previous designs had ribbing which extended downward from the bottom surface 812. However, in the embodiment of FIG. 8, the ribbing 814 extends upward and, preferably, is integrally formed with the bottom plate 812 which is also integral with the remainder of the base portion 814. In order to provide a smooth inner surface for the container, a separate plate 816, not integral with the ribs 814, is placed on top of the ribs 814. Without wishing to be bound by any theory, it is believed that the upward extending ribs provide a stronger, stiffer configuration, for a given amount or mass of ribbing than a downward extending configuration, primarily because the plastic materials from which these containers are preferably formed is better in compression than in tension. This permits a container to achieve the same load capacity with fewer ribs and therefore less material. Furthermore, the configuration with upward extending ribs is, for most configurations, easier to manufacturer than a downward-extending rib structure.

Figure 8:
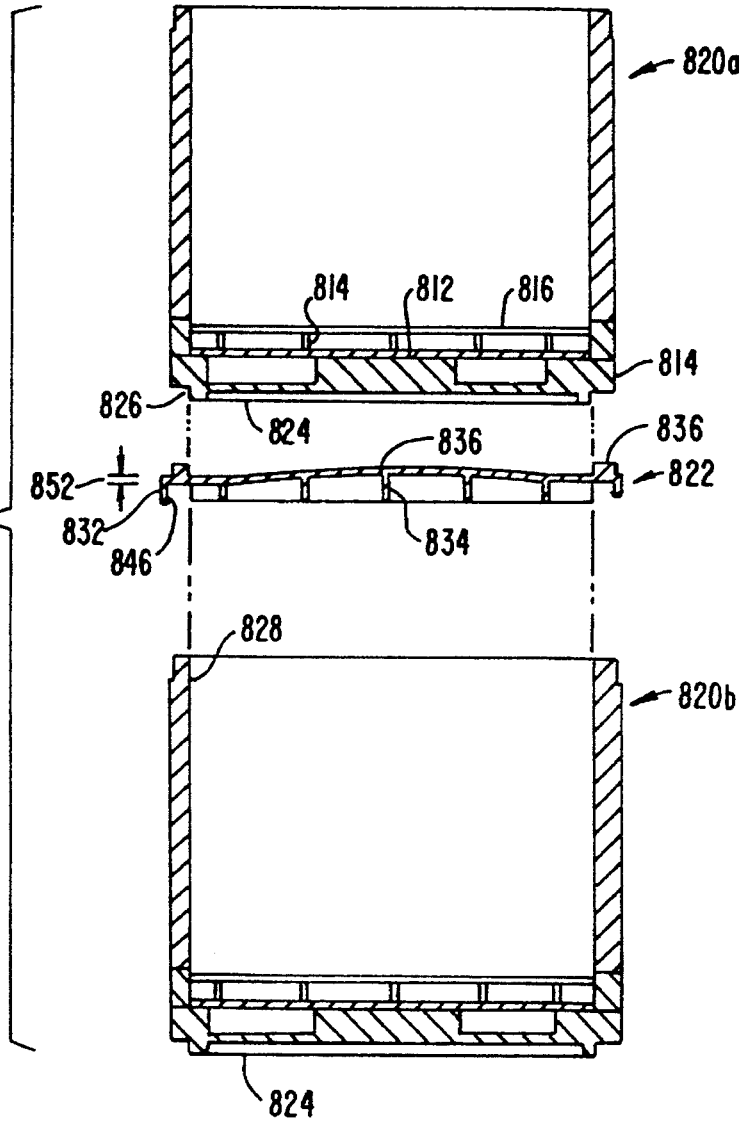
FIG. 8 is a top plan view of a base portion of a container, showing the ribbing thereof, according to one embodiment of the present invention.
Figure 9:
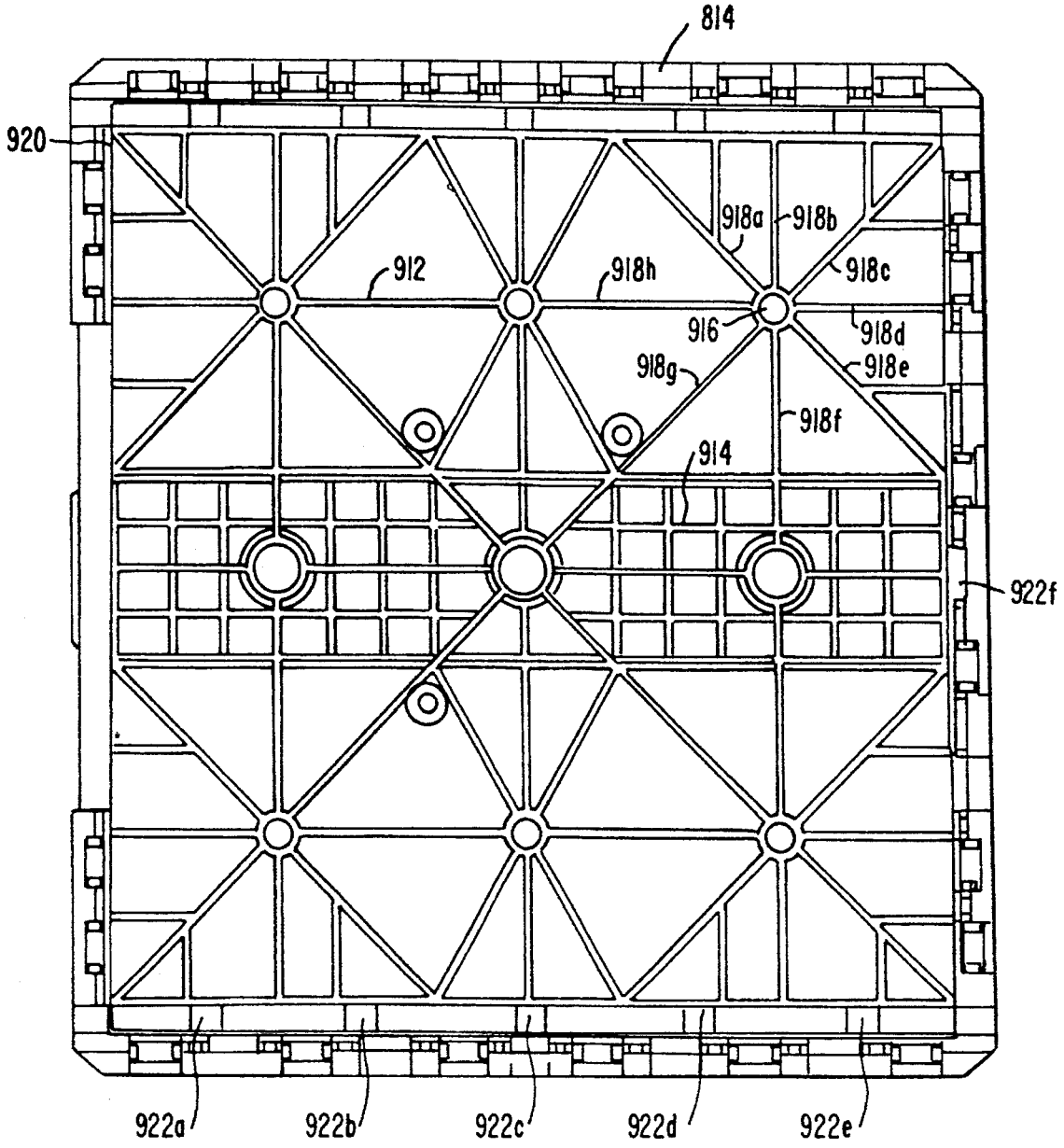
FIG. 9 is an end view of an interior plate according to one embodiment of the invention.

FIG. 9 is a plan view of the base 814 of the embodiment in FIG. 8, showing the configuration of ribbing 912 according to one embodiment of the present invention. As seen in FIG. 9, the ribbing includes a central region with square or rectangular-shaped ribbing. Also shown in FIG. 9 are a plurality of closed-loop, preferably, circular ribs 916. In the embodiment of FIG. 9, a number of ribs 918*a*–918*h* radiate away from the circular rib 916. Preferably, the radiating ribs 918*a*–918*h* are integrally-formed with a circular rib 916.

Figure 10:
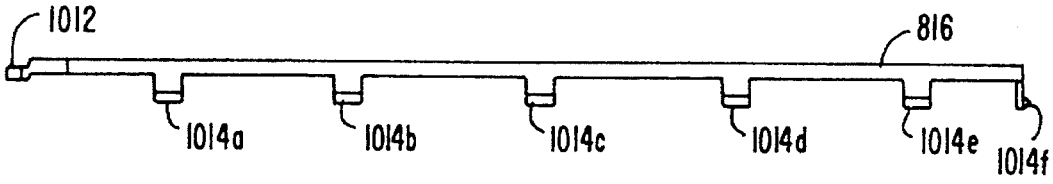
FIG. 10 is a cross-sectional view, partially exploded, of first and second stacked containers with a lid for the bottom container, taken along line 8—8 of FIG. 11.

FIG. 10 is a detailed cross-section view of a plate 816 for covering the ribs 814. In the embodiment of FIG. 10, one edge of the rib contains tabs 1012 for insertion in corresponding slots 920 of the base. Other edges contain a plurality of downwardly extending cammed tabs 1014*a*–1014*f* for resiliently latching into openings 922*a*–922*f* of the base 814.

Figure 11:
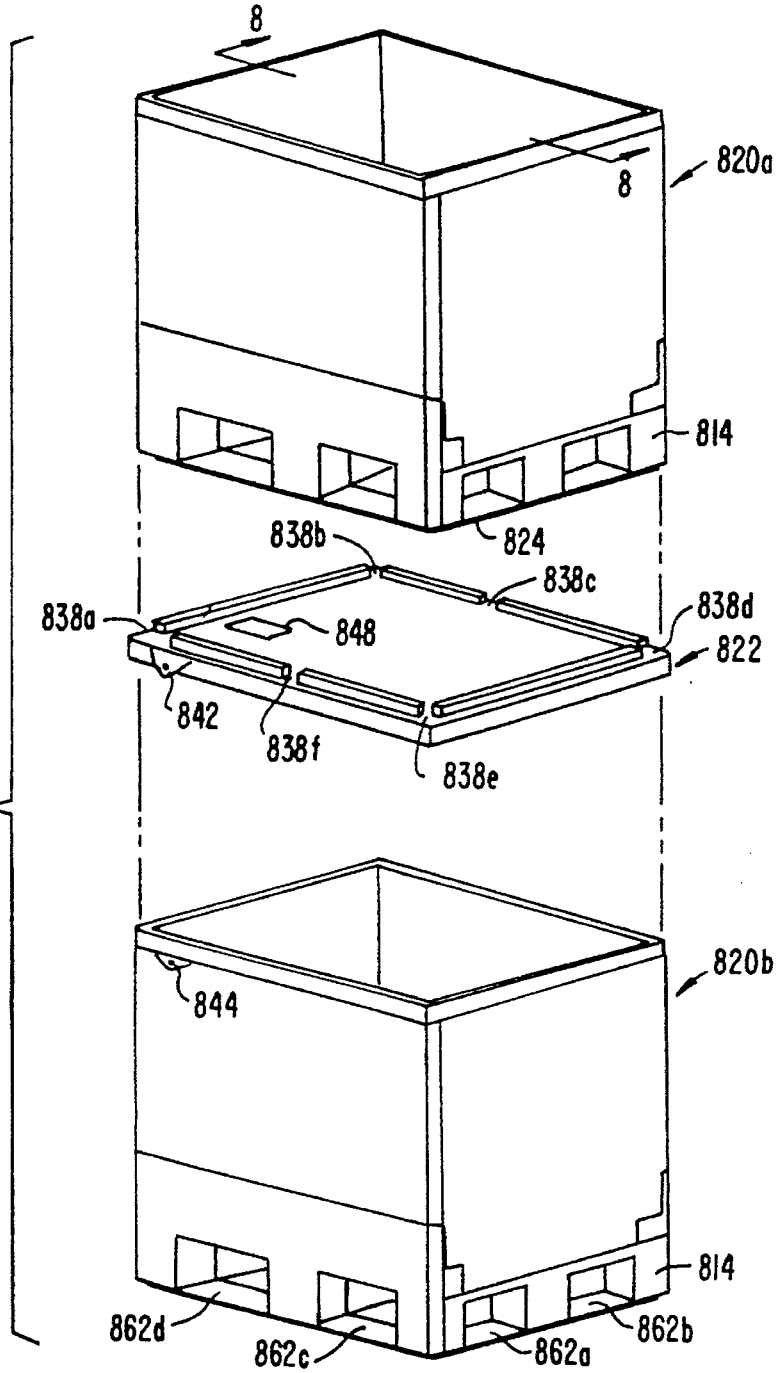
FIG. 11 is an exploded perspective view of first and second containers in a stacked configuration and a lid provided for the lower containers.

As shown in FIGS. 8 and 11, according to one embodiment, the containers 820*a*, 820*b* can be stacked, one on top of the other, either with or without a top or lid 822 placed over one or more of the containers. To provide for stable stacking in the absence of lids 822, the lowermost surface 824 of the base 814 is recessed inwardly from the vertical planes defined by the sidewalls and base to define a peripheral shoulder area 826. The shoulder area 826 has a size and shape to fit within the rim 828 defined by the upper edges of the container 820*b* below. Although the shoulder 826 is depicted as continuous, the shoulder could also be divided so as to define the plurality of feet of the container 820.

When a top 822 is to be provided, e.g., over lower container 820*b*, the top is configured with a flange 832 fitting around the outside circumference of the upper portion of the container 820. In one embodiment, to provide stiffness to the lid 822, a plurality of ribs 834 are formed on the underside of the lid 822. In the embodiment depicted in FIG. 8, the lid 822 has a somewhat convex or domed-shape 836. This provides for draining away of liquids such as rainwater, towards the edge of the lid 822. The ribs 834 help maintain the domed shape 836 of the lid 822. In the embodiment depicted in FIG. 8, the upper surface of the lid 822 is provided with a upward-extending ridge 836 positioned around the periphery of the lid 822. Preferably, the ridge 836 is configured to mate with the ledge 826 so that the bottom surface 834 and upper container 820*a* fits within the area defined by the ridge 836. Preferably, the ridge 836 has a plurality of channels or gaps 838*a*–838*f* so that rainwater or other liquids formed on top of the lid will not pool, but will be allowed to drain through the channels 838*a*–838*f* and off the lid 822. Preferably, the lids 822 include a eyelet 842 for securing, e.g., via padlock, the lid 822 to a container, such as to a corresponding eyelet 844 formed on the container 820*b*.

Preferably, the lids 822 contain detentes 846 formed in the inside surface of the flange 832 for coupling to the container 820*b* to prevent or reduce the tendency to be blown off the containers, e.g., during shipment. A recessed area 848 may be provided for accommodating a plate, e.g., for furnishing a logo or other identification.

As seen in FIG. 8, the lid 822 adds only a small amount 852 to the height of the stack, corresponding generally, to the thickness of the web or covering portion of the lid 822 and, in one embodiment, adding only about 0.25 inches to the height of a container-lid combination.

As seen in FIG. 11, preferably, entry ways 862*a*, 862*b*, 862*c*, 862*d* for accommodating the forks of a forklift are provided in a plurality of the vertical surfaces of the base 814 and preferably, in all four surfaces of the base 814 so as to provide for four-way forklift entry.

Figure 12:
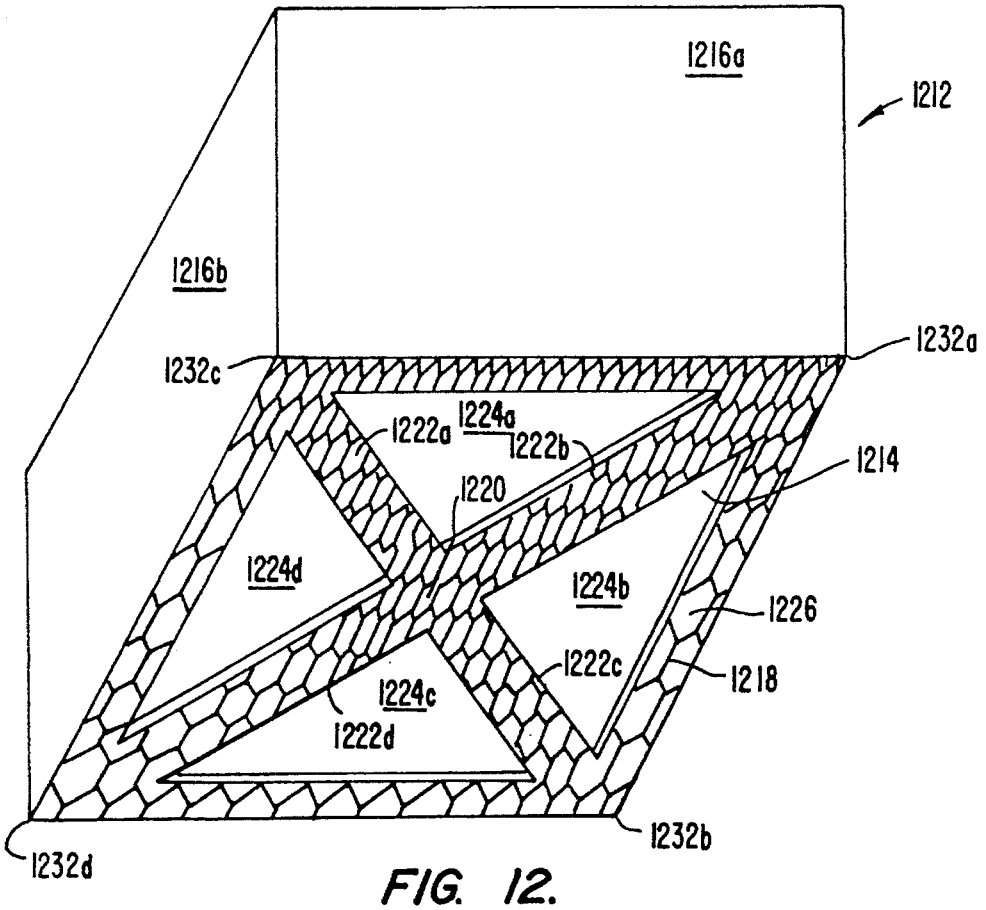
FIG. 12 is a bottom perspective view of a simplified container according to one embodiment of the invention.

FIG. 12 depicts a feature according to an embodiment of the invention, for assisting in preventing deflection of the bottom surface of a container. FIG. 12 is an idealized or simplified view of a container 1212 having a bottom surface 1214 and a plurality of sidewalls extending upward therefrom 1216*a*, 1216*b*. Hexagonal ribbing 1218, i.e., ribbing defining a plurality of generally hexagonal or honeycomb-shaped cells extend downwardly from portions of the bottom surface 1214. Not all portions of the bottom surface contain the hexagonal ribbing 1218. In the depicted embodiment, the ribbing is provided over a central region 1220 and also over arms 1222*a*, 1222*b*, 1222*c*, 1222*d* extending from the central region 1220 towards the corners of the container 1212. The regions or interstices 1224*a*, 1224*b*, 1224*c*, 1224*d* are free from hexagonal ribbing. In the embodiment depicted in FIG. 12, the periphery of the bottom surface 1226 optionally contains hexagonal ribbing. The configuration of FIG. 12 is provided in order to prevent or reduce the amount of sag developed in containers and also to reduce the deflection of the bottom surface of the container. Without wishing to be bound by any theory, it is believed that the honeycomb-like X-shaped structure depicted in FIG. 12 tends to transfer load from the center area 1220 and, possibly, from the centers of the sidewalls 1216*a*, 1216*b* towards the corners 1232*a*, 1232*b*, 1232*c*, 1232*d* of the container. As can be seen from FIG. 12, the X-shaped configuration does not require placement of beams across the lower surface and thus provides for a manner of avoiding sag without interfering with a four-way forklift entry.

Figure 13:
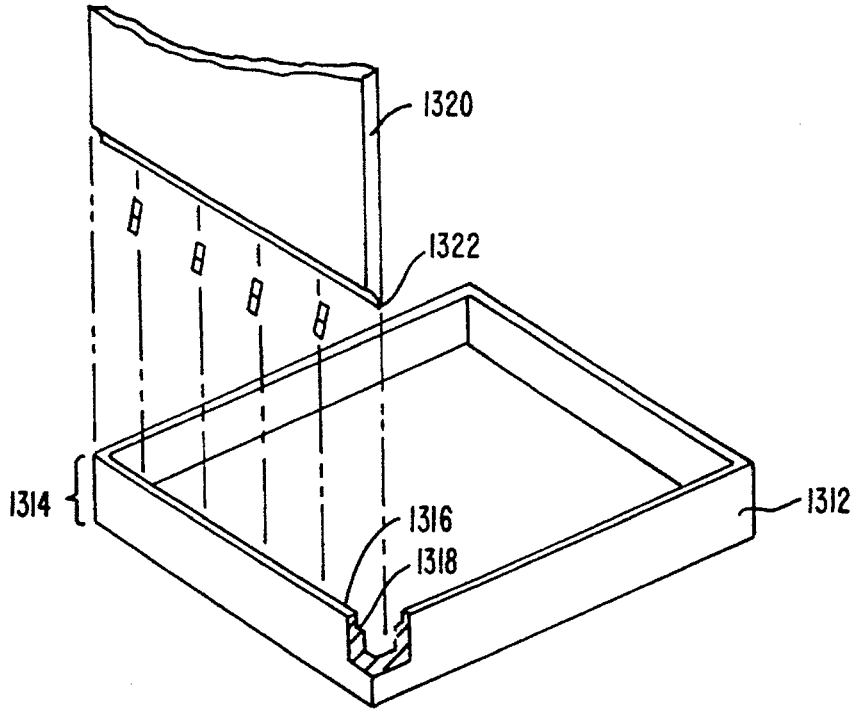
FIG. 13 is an exploded, partial view of a container rim and one sidewall in a simplified version according to one embodiment of the invention.

As depicted in FIG. 13, according to one embodiment of the invention, the base 1312 contains an upstanding rim portion 1314. Preferably, the upstanding rim portion 1314 has an upwardly extending lip 1316 defining a shoulder 1318. In this embodiment, the lip 1316 and shoulder 1318 are substantially continuous around the periphery of the rim 1314. Similarly, the sidewalls contain a downwardly extending lip 1322 configured to fit on the inside or interior surface of the base rim lip 1316 and to continuously contact such lip. In this way, outward loading of the sidewall 1320 is transferred to the base 1312.

Preferably, the sidewall 1320 is connected to the rim 1314 by a plurality of hinges. A number of hinge configurations can be used, including those described in U.S. Pat. Nos. 5,114,037, and 5,199,592, supra. Preferably, the hinges can be coupled to the sidewall 1320 and rim 1314 without requiring substantial discontinuities in the lips 1316, 1322. By avoiding substantial discontinuity in the lips 1316, 1322, it is believed that concentration of force or stress is avoided resulting in reduction of deflection and a lower failure rate. Although the embodiment depicted in FIG. 13 is a simplified embodiment showing substantially linear lips, in some configurations the rim and lower portion of the sidewall 1320 will be convoluted or crenelated, e.g., as depicted in U.S. Pat. Nos. 5,114,037 and 5,199,592, supra.

Figure 14B:
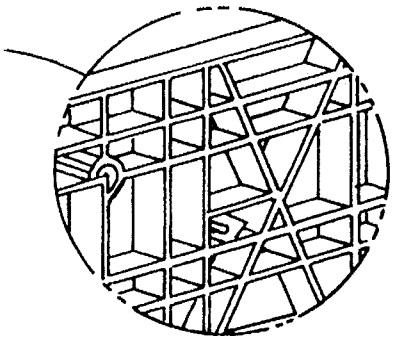
FIG. 14 is a perspective view of a container according to one embodiment of the invention showing ribbing of the container.
Figure 14A:
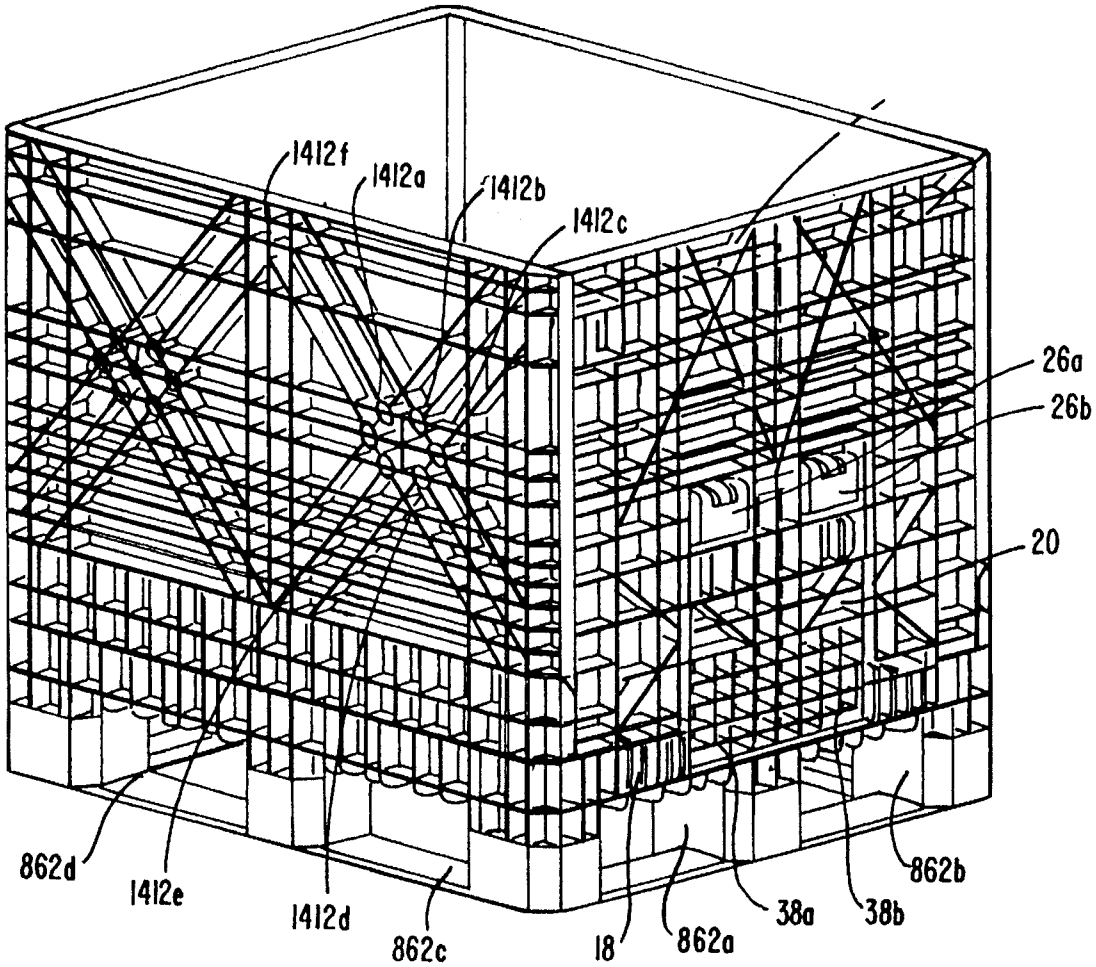

Another aspect of the invention which contributes to reduction in deflection is the rib patterns provided in the container, particularly the rib patterns provided on the surfaces, such as the exterior surfaces, of the sidewalls. FIG. 14 depicts a sidewall pattern including a plurality of closed-path, preferably circular ribs 1412*a*–1412*f*. In the embodiment of FIG. 12, the circular ribs 1412*a*–1412*f* are integrally formed with a plurality of linear ribs extending or radiating therefrom. As seen in FIG. 14, in one embodiment, at least one of the linear ribs extends through the circular rib, bisecting it. In the embodiment of FIG. 14, the linear ribs are grouped into three groups of parallel ribs with the circular ribs lying at the intersections of the groups of parallel ribs with one another. The provision of circular ribs and intersecting integral radial ribs is believed to provide a high stiffness and reduced deflection.

In light of the above description, a number of advantages of the present invention can be see. The present invention provides for a reduction in sagging and/or deflection, preferably while retaining the ability to accommodate four-way forklift entry. The present invention provides for an upward-swinging door in the lower portion of at least one sidewall, particularly for use in connection with bulk materials. Preferably, the door is configured to relieve outward force on the door hinges. The door is preferably provided with a slam latch configured to permit the door to be held in the open configuration by slamming it against the latch and to disengage the latch by rapidly pulling the door towards the closed position. A container which provides greater strength per weight can be achieved using ribbing which extends upwardly from the bottom or shear plate with a separate non-integral cover plate over the ribs, if desired. Container lids are provided with features for preventing pooling of water or other liquids, including a dome-shape and channels for drainage. The lids preferably avoid blowing off or other unwanted detachment such as by including detentes and/or padlock facilities.

A number of variations and modifications of the invention can be used. For example, it is possible to use some aspects of the invention without using other aspects. For example, a container which included an upward-swinging door in the bottom portion but did not contain the ribbing pattern with circular ribs would be operable. A container which included a rib extending upwardly on a bottom plate but did not provide X-shaped load-transfer bottom ribbing would be operable. The upward swinging or bulk door could be provided in one, two, three or all four sides of a four-walled container, and could be provided, for example, without side latches 42*a*, 42*b*. A hold-open latch could be provided which did not have a jerk-release feature and/or which did not pivot outward from a storage position to an active position. Other means of attaching the bottom plate 816 to the base could be used including screws, bolts, adhesives, ultrasonic welding and the like. Closed loop ribbing can have a shaped other than circular, including oval, elliptical, and the like.

Although the application has been described by way of a preferred embodiment and certain variations and modifications, other variations and modifications can also be used, the invention being defined by the following claims.

What is claimed is:

1. A collapsible container usable for holding bulk material, comprising:

a base having a plurality of linear edges;

a plurality of sidewalls, each having a lower edge, and an opposite upper edge and coupled to one of said linear edges along said lower edge so as to be movable between an upright position and a collapsed position, at least a first of said plurality of sidewalls having an opening formed in the lower portion thereof, said opening extending to said lower edge, without extending to said upper edge, said opening having a top edge, two side edges, and a bottom edge;

a door, substantially defining a plane, configured to fit substantially within said opening and pivotally connected to said top edge of said opening so as to permit pivoting from a closed configuration, outward and upward toward an open configuration; and a latch, configured to couple said door to said base in said closed configuration.

2. A collapsible container, as claimed in claim 1, further comprising a latch coupling said door to one of said side edges of said opening.

3. A collapsible container, as claimed in claim 1, wherein said door, in said open configuration is positioned above said opening, substantially parallel with said first sidewall.

4. A collapsible container, as claimed in claim 1, further comprising a hold-open latch configured to hold said door in said open configuration.

5. A collapsible container, as claimed in claim 4, wherein said hold-open latch includes a retaining surface, contacting and holding said-door in said open position and a camming surface configured to permit engagement of said retaining surface with said door by slamming said door against said camming surface.

6. A collapsible container, as claimed in claim 5, wherein said retaining surface is sloped with respect to said plane of said door to permit said door to be disengaged from said hold-open latch by pulling said door outward and downward.

7. A collapsible container, as claimed in claim 4, wherein said hold-open latch is pivotable between an operating configuration extending outward from said first sidewall, and a stored configuration, without extending outward from said first sidewall.

* * * * *